United States Patent [19]

Stephens et al.

[11] Patent Number: 4,485,298

[45] Date of Patent: Nov. 27, 1984

[54] PERFORATING STYLUS

[75] Inventors: Richard J. Stephens, St. Charles, Ill.; Harry H. Boucher, Dallas, Tex.

[73] Assignee: Election Data Corporation, St. Charles, Ill.

[21] Appl. No.: 398,115

[22] Filed: Jul. 14, 1982

[51] Int. Cl.[3] ..... G07C 13/00

[52] U.S. Cl. ..... 235/50 R; 235/50 A; 235/50 B; 225/93

[58] Field of Search ..... 235/50 R, 50 A, 50 B; 178/87; 225/93; 269/15, 293

[56] References Cited

U.S. PATENT DOCUMENTS

| | | | |
|---|---|---|---|
| D. 222,399 | 10/1971 | Laws et al. | D19/77 |
| 278,091 | 5/1883 | Burk | 269/293 |
| 2,923,452 | 2/1960 | Holovka, Jr. | 225/93 |
| 2,949,292 | 8/1960 | Abissi | 269/293 X |
| 3,007,620 | 11/1961 | Lagramboise et al. | 225/93 |
| 3,201,038 | 8/1965 | Harris | 235/50 R |
| 3,240,409 | 3/1966 | Harris | 225/93 |
| 3,424,376 | 1/1969 | Evans | 235/50 R |
| 3,536,257 | 10/1970 | Laws | 235/50 B |
| 4,258,349 | 3/1981 | Ahmann | 235/50 R |

*Primary Examiner*—Benjamin R. Fuller
*Attorney, Agent, or Firm*—Emrich & Dithmar

[57] ABSTRACT

A stylus for entering perforations in a prescored card for the recording of data thereon is disclosed. The perforating end of the stylus includes a conically-shaped center portion positioned within and projecting from a concave-shaped end surface having a sharp edge around the periphery thereof. The scored portion of a card is initially engaged by the sharp cone-shaped tip of the stylus and partially displaced thereby. Continued displacement of the stylus causes the sharp peripheral edge thereof to engage and sever a portion of the card defined by the stylus tip cross section. The sequential and complementary action of the pointed center tip and the sharp-edged periphery of the stylus in engaging the prescored portion of a data card causes the thus engaged portion to be completely severed and displaced from the card in eliminating the need to subsequently wipe the card to remove partially severed chips, or punched portions, therefrom.

9 Claims, 10 Drawing Figures

FIG-1
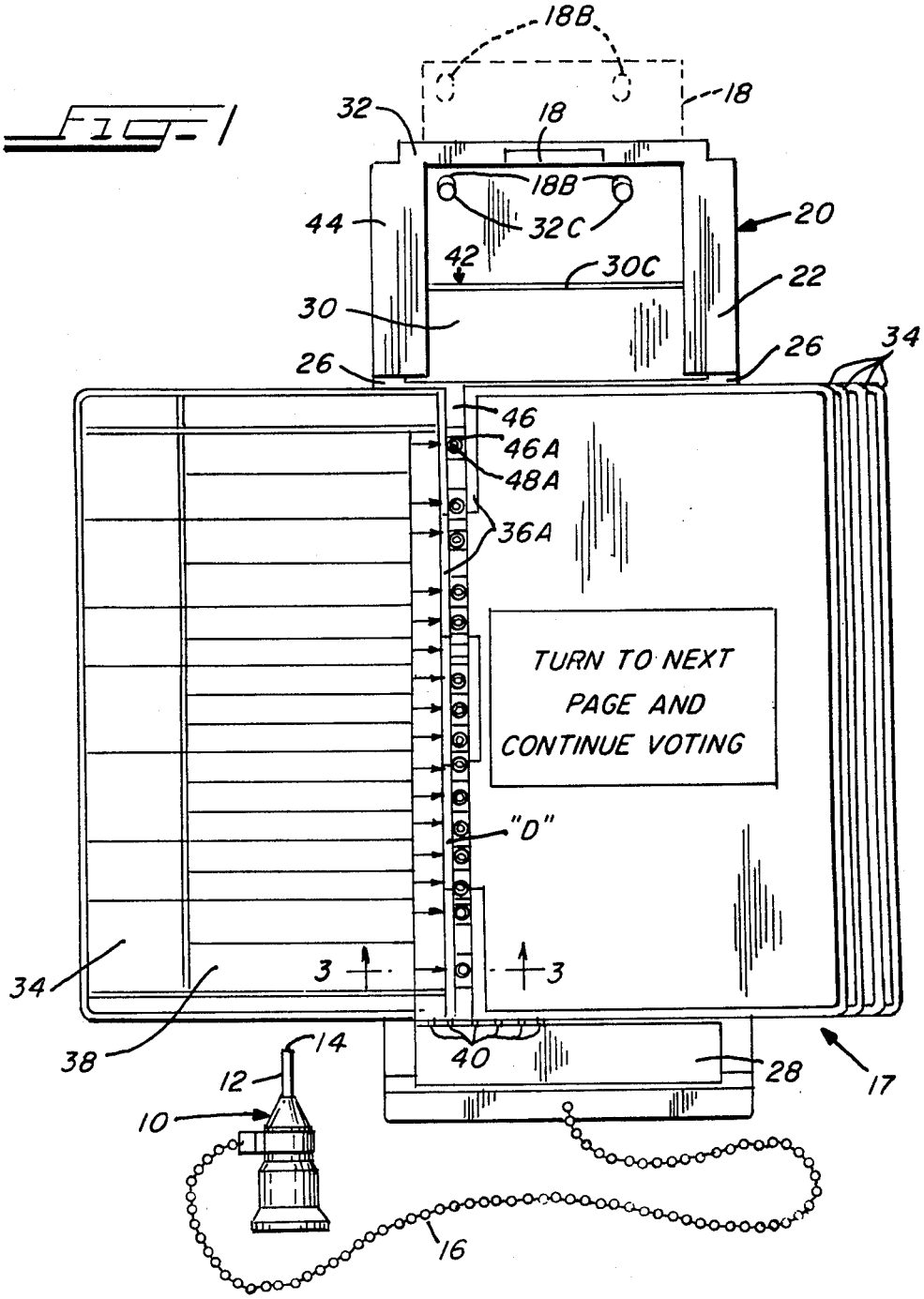
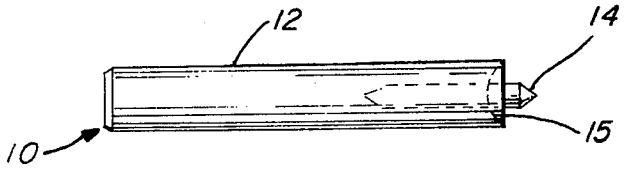
FIG-10

PERFORATING STYLUS

CROSS-REFERENCE TO RELATED APPLICATION

The present application is related to but not dependent upon the following co-pending application: "DATA REGISTERING APPARATUS", Ser. No. 398,116 filed July 14, 1982, in the name of Richard J. Stephens and Harry H. Boucher.

BACKGROUND OF THE INVENTION

This invention relates to a device for punching out prescored portions of a sheet material so as to completely sever and remove said punched-out portions from the sheet material.

Devices for facilitating the recording of information on a record card by punching out previously scored portions of the card typically include a backing plate containing a plurality of holes corresponding to the index positions in the record card. The backing plate may also be provided with means to receive and position a record card above the plate with its index positions aligned with the holes in the backing plate. The index positions of the record cards are defined by scorings which enclose substantially but not completely the individual index positions thus weakening the bond between these areas and the surrounding portions of the record card. The prescored record card is inserted in the perforating device above the perforated backing plate and held in position by guides or other means with its index positions aligned with the holes in the base plate. The user then presses a hand-held stylus against any desired index position in the record card. The pressure thus applied on the stylus breaks the weakened index area away from the surrounding record card and forces the punched-out chip through the corresponding hole in the backing plate. In this manner, data is recorded on the card for subsequent use.

The use of perforated data cards for recording information is widespread ranging from voting ballots to payroll checks to numerically controlled machine operation. The perforations made in the data card must be of precisely defined dimensions and made in a sharp manner so as to leave the apertures thus formed free from ragged edges. The apertures thus formed in this punching process must be well defined so as to minimize the possibility of erroneous readings by the processing machine which senses the data entries. Moreover, after the stylus is inserted through a selected prescored area on the data card and is then withdrawn, the chip or card portion within the selected prescored area is frequently merely folded downwardly on the card along an edge of the aperture thus formed and remains attached to the data card. This frequently results in the reading of erroneous data from the card which is, particularly in the case of vote counting, highly undesirable.

The prior art discloses various record card processing systems and improvements in such systems. U.S. Pat. No. 2,923,452 to Holovka discloses a perforating mechanism for record cards having index positions defined by interrupted slits wherein the perforations are made by exerting force upon the area within the interrupted slits so as to rupture the connecting ties holding the bounded area integral with the record card. U.S. Pat. No. 3,240,409 to Harris similarly discloses a data registering device including a card supporting structure having a plurality of apertures upon which the data card is positioned. Also included is a frame upon which are mounted a plurality of leaf members into which a data card may be inserted. The leaf sections may then be turned in a book-like manner to expose an adjacent data card upon which data may be entered.

U.S. Pat. No. 2,949,292 to Abissi and U.S. Pat. No. 3,536,257 to Laws disclose perforating apparatus intended to insure the complete separation of a chip or card portion within a selected prescored area. The former patent includes flexed portions of a resilient backing means which close and grip the punch-out as the pressure from the punching means is removed therefrom, thus gripping the punch-out sufficiently firmly to remove it from the sheet when the work piece is removed from the apparatus. The latter patent allegedly accomplishes this end by means of a plurality of elongated slotted openings arranged in rows to match in underlying, confronting relation, prescored areas on a machine processable ballot. Each slot or opening is defined by a pair of elongated sides which are closely spaced apart and deflected downwardly and outwardly in opposite directions upon downward movement of the stylus through the slots. On upward withdrawal of the stylus after the punching operation has been completed, the edges of the slot are drawn inwardly and tightly against the stylus, and remove the punched-out chip or ballot portion from the stylus and ballot and retain the chip below the mat. While allegedly accomplishing the desired end of insuring the separation of the punched-out portion from the data card, both of the aforementioned approaches require a somewhat complex, multi-layered structure positioned beneath the data card supporting structure and increase the complexity and cost of the perforating apparatus. Also it is to be noted that all of the aforementioned approaches envision the use of a blunt-ended stylus for displacing the prescored portion of the data card. U.S. Pat. No. Des. 222,399 to Laws et al discloses a card punching stylus having a blunt engaging end which is representative of the general configuration of such devices in the prior art.

The present invention is intended to overcome the aforementioned limitations of the prior art by providing an improved and inexpensive means for perforating a prescored data card which insures the complete and well defined separation of the engaged, prescored portion of the data card without requiring additional card supporting structure to accomplish this end.

SUMMARY OF THE INVENTION

Accordingly, it is one object of the present invention to provide an apparatus for producing well defined, critically dimensioned, index slits in a record card by punching out prescored index portions thereof while insuring the complete severance and positive removal of the punched-out index portions from the record card.

The present invention contemplates a stylus with one end thereof particularly adapted for perforating a prescored data card. The perforating end of the stylus includes a conically-shaped center portion having a sharp tip associated therewith. A concave-shaped portion of the stylus is positioned around the conically-shaped center portion and includes a sharp-edged periphery. The prescored portion of the data card is initially engaged and displaced by the pointed center tip of the hand-held stylus. The periphery of the perforated portion is then engaged and sharply severed by the edged periphery of the stylus resulting in the complete and positive separation of the punched-out portion of the data card from the remainder thereof.

BRIEF DESCRIPTION OF THE DRAWINGS

The appended claims set forth those novel features believed characteristic of the invention. However, the invention itself as well as further objects and advantages thereof will best be understood by reference to the following detailed description of a preferred embodiment taken in conjunction with the accompanying drawings, where like reference characters identify like elements throughout the various figures, in which:

FIG. 1 is a top elevational view of a conventional data registering device and a perforating stylus in accordance with the present invention;

FIG. 10 is a partially cut away side view of a perforating stylus in accordance with the present invention.

DESCRIPTION OF THE PREFERRED EMBODIMENT

Figure 2:
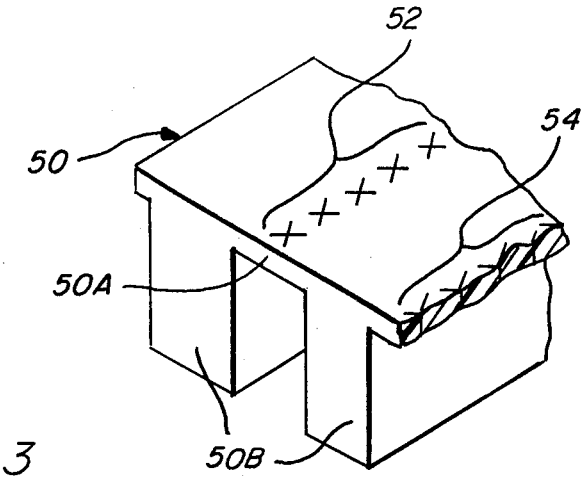
FIG. 2 is a perspective view of a data card supporting element including X-shaped scored portions therein.

Referring to FIG. 1, there is shown a perforating stylus 10 in accordance with the present invention for use with a conventional data card recording apparatus 17. Although the recording apparatus 17 is shown as a ballot holding apparatus for vote recording purposes, the perforating stylus 10 of the present invention is compatible with any conventional data card recording system in which prescored portions of the data card are punched-out in providing a permanent data record.

The configuration and operation of the vote recording apparatus 17 will now be briefly described in order to provide a more complete understanding of how the perforating stylus 10 of the present invention is utilized and operates. The vote recording apparatus 17 includes a ballot holding framework generally referred to by the numeral 20. The perforating stylus 10 of the present invention is connected to the vote recording apparatus by a flexible chain 16 to allow the voter to manipulate the stylus as desired when making selections. The ballot holding framework 20 is adapted to receive a machine processable ballot 17 inserted therein with the voter indicating his selections by punching out selected prescored areas 18A (a typical prescored area is shown in FIGS. 3–8). The prescored areas 18A are typically formed in a stamping operation in which the perimeter of the area is outlined and the surface indented to provide for a clean, punch out operation when the stylus is used.

As the user enters data or information, the lower, or tip, portion 14 of the stylus 10 is forced through the prescored data card causing a small chip or card portion to be removed therefrom leaving a clean slot or opening which typically is subsequently machine counted in an automatic data compiling process. The chips or punched out portions of the data card are referred to herein by the reference numeral 18A and, once the chips are punched out of the data card they are permanently separated from the remaining portion of the data card and are retained in the interior of the vote recording apparatus 17 as can be seen in FIGS. 3 through 8, which are described in detail below.

The ballot, or data card, holder 20 is preferably formed of a molded plastic material and includes an upper, generally rectangular framework 22 and a separate, lower base member or frame (not shown in FIG. 1). The rectangular shaped upper framework 22 includes a pair of longitudinal, opposite side members 26 of angular cross section, a lower, transverse cross member or end member 28, an intermediate, transverse cross member 30 and an upper transverse cross member 32. In order to direct the voter's attention to the proper row of prescored areas 18A on the ballot card 18 for making his selection, the vote recording apparatus 17 includes a plurality of voting information leaves 34. The leaves 34 are pivotally mounted on the upper framework 22 of the ballot holder 20 and are read in succession by the voter during the voting procedure. After the issues depicted on one leaf have been voted, the next leaf is turned over and voted and the process is continued until the voter has completed all of his selections. Each voting information leaf includes an outer, protective envelope or jacket formed of tough, clear, flexible plastic material and a voting information sheet 38 is contained in the jacket for directing the voter's attention to the relevant area on the ballot.

After the appropriate voting information sheet has been inserted into a plastic envelope, an elongated hinge pin 40 is threaded into coaxially aligned, tubular socket portions 36A formed on alternate, opposite side members of the envelope along the open edge "D". Insertion of the hinge pin closes the envelope and the completed voting information leaf 34 is then pivotally mounted on the upper framework 22 of the ballot holder 20 on a vote recorder.

To provide for the easy insertion of a ballot 18 into the ballot holding framework 20 for vote recording, the upwardly facing edge 30C of the intermediate cross member 30 and the opposite, downwardly facing, lower edge of the upper cross member 32 are spaced apart, thereby defining a slot or opening 42 for receiving the lower end portion of the ballot 18 as it is inserted downwardly into the vote recording apparatus 17 from the upper end of the ballot holder 20. For this purpose the opposing edge surfaces of the respective cross members 30, 32 are rounded, and the underside of the cross member 30 is curved to guide the ballot into proper place as it is inserted into the vote recording apparatus 17.

The ballot holding framework 20 includes a pair of upstanding side guide bosses or projections 44 having a vertical inside face adapted to guide the longitudinal side edges of the ballot into the ballot opening 42. The upper surface of the main portion of the upper end cross member 32 is sloped at an angle similar to the curved underside of the intermediate cross member 30 and serves to guide the card or ballot 18 through the opening 42 into a fully inserted voting position wherein the voter makes selections by punching out the card with the stylus 10. In order to lock and hold the ballot 18 in the fully inserted voting position in the ballot holding framework 20, a pair of integrally formed, upstanding locating projections 32C are integrally formed to project upwardly from the sloped surface of the upper end cross member 32, and the locating pins are rounded at their upper ends for easy engagement with appropriately located holes or openings 18B formed adjacent the upper edge of the ballot card. The openings 18B are spaced eccentrically of the longitudinal center line of the ballot so that the ballot may be locked into position with the pins 32C in the openings only when the printed matter on the ballot is facing upwardly, thereby insuring that proper areas are punched to accurately reflect the voter selections.

A masking card 46 is provided having a plurality of circular openings 46A each being located appropriately over a prescored punch out area 18A which is to be available to the voter in making his selection. The masking card 46 covers unused spaces in a row of the vote recording apparatus 17 in order to reduce the possibility of erroneous entries. Because the number of rows being used varies from election to election, the number and location of the openings 46A in a mask 46 varies for each election. The mask 46 is preferably constructed of relatively stiff cardboard or card stock and is perforated appropriately for the election.

Figure 3:
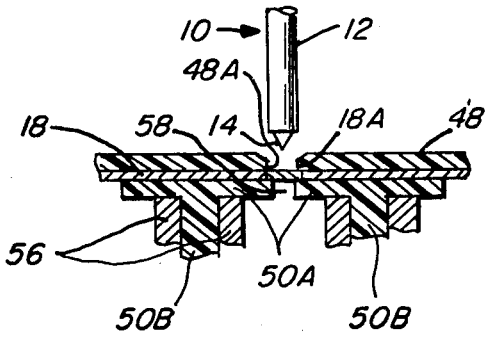
FIGS. 3 through 8 show a series of fragmentary cross sectional views of the operation of the perforating stylus of the present invention in separating and displacing a prescored portion of a data card.
Figure 4:
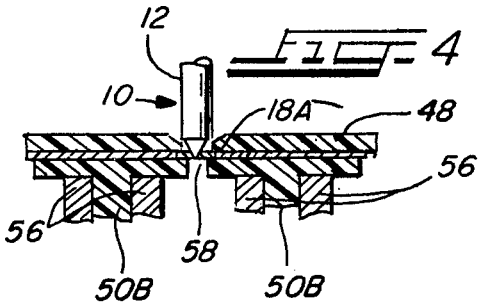
Figure 5:
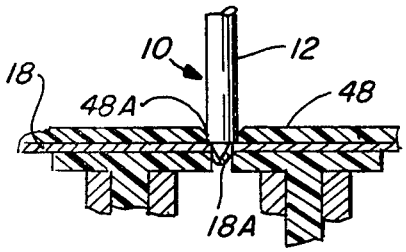

When the voter desires to make an entry, the stylus 10 is grasped and centered upon the appropriate opening 46A in the mask 46 and the concentrically aligned opening 48A in the die which is positioned beneath the mask 46. The stylus is then moved downwardly wherein the lower tip portion 14 passes through and is guided by opening 48A in the die 48 and begins to engage a chip defined within a selected prescored area 18A on the ballot, as shown in FIGS. 3 through 5. Further downward movement of the stylus causes the chip to be punched downwardly and removed cleanly from the ballot in a manner to be explained with reference to FIGS. 3 through 8. The chip is initially carried along the tip of the stylus 10 and falls from the stylus tip into the bottom of the ballot holding framework 20. Additional details regarding the operation and configuration of a conventional vote recorder may be found in the aforementioned U.S. Pat. No. 3,536,257.

The perforating stylus of the present invention is described with respect to the aforementioned vote recording machine merely for illustrative purposes in providing an example of the general usage of a perforating stylus. The present invention, however, is not limited to use with a vote recording apparatus, but is equally compatible with any data recording system wherein the information is punched onto prescored data cards.

Referring to FIG. 2, there is shown a perspective view of the general configuration of a chip retaining mat 50 for supporting a ballot thereon in a voting position within the ballot holding framework. The chip retaining map 50 has a planar upper portion 50A and is preferably formed of a sheet of resilient, plastic material. The chip retaining mat 50 is of rectangular shape and is substantially equal in size to the voting portion of the ballot 18, which it underlies and supports. The upper planar portion 50A of the chip retaining mat includes a plurality of linear arrays of prescored X's 52, 54. It is through the respective X's that the stylus is inserted during the process of data entry. The stylus initially perforates the overlying data card and then is displaced through a prescored X immediately underlying the data entry location in the card. This allows for the complete separation of the chip from the data card. The X's are prescored on the chip retaining mat 50 and the stylus is preferably inserted through the center crossing portion of each X. A chip retaining mat utilized with a preferred embodiment of the present invention is described in the above referenced patent application.

The chip retaining mat 50 includes a plurality of vertically oriented, spaced, parallel flanges 50B. These parallel flanges 50B extend generally the entire length of the chip retaining mat 50 and are oriented in parallel with and spaced between immediately adjacent linear arrays of prescored X's. This configuration provides support for the planar upper portion 50A of the chip retaining mat 50 while permitting the stylus to be inserted in and displaced through the chip retaining mat 50. Referring to FIGS. 3–8, there is shown a plurality of generally vertically oriented support ribs 56 positioned on each side of the spaced, parallel flanges 50B for providing support for the chip retaining mat 50. These support ribs 56 are securely mounted to a lower portion of the vote recording apparatus in a conventional manner.

Referring to FIGS. 3 through 8, there is shown a series of fragmentary cross sectional views taken along the line 3—3 of FIG. 1 showing the operation of the stylus 10 and chip retaining mat 50 combination in removing a prescored area of a ballot or data card 18. Referring to FIG. 3, the perforating stylus 10 is shown in a position prior to contact with the data card 18 which includes a prescored area 18A for data entry. The stylus includes a shaft portion 12 and a tip portion 14. The upper planar portion 50A of the chip retaining mat 50 includes an aperture 58 positioned immediately below the prescored area of the data card 18. The aperture 58 represents a conventional configuration for the chip retaining mat 50 and not a chip retaining mat with prescored X's therein as shown in FIG. 2. In a more conventional chip retaining mat the aperture through which the stylus is inserted after piercing the data card is in the form of a linear space running the length of the chip retaining mat. This is the chip retaining mat configuration shown in FIGS. 3–8 and the configuration to be used in explaining the operation of the present invention, although the perforating stylus of the present invention will operate equally as well with the chip retaining mat configuration of FIG. 2.

Referring to FIG. 4, the tip portion 14 of the stylus is shown in contact with the prescored portion 18A of the data card 18. FIG. 5 shows further downward displacement of the perforating stylus 10 with the tip portion 14 thereof further deforming and displacing the prescored portion 18A of the data card 18. Thus far, only the tip portion 14 of the perforating stylus has contacted the data card.

Figure 6:
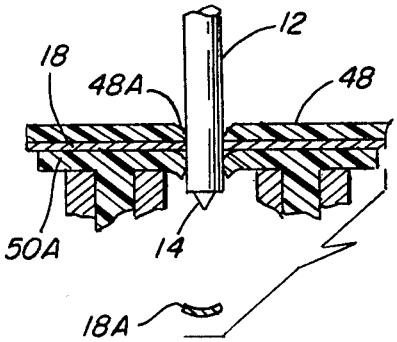
Figure 7:
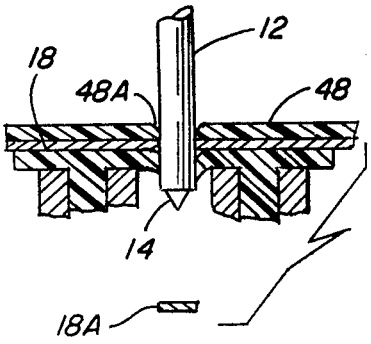
Figure 8:
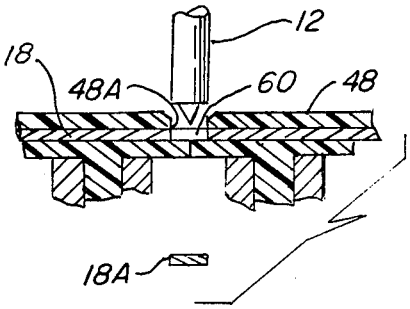
Figure 9:
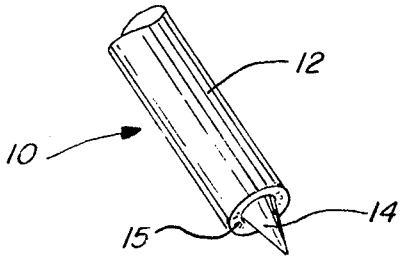
FIG. 9 is a perspective view of the engaging tip of a perforating stylus in accordance with the present invention.

FIGS. 6–8 will be explained with reference to FIGS. 9 and 10 which show the stylus 10 and particularly the tip portion 14 thereof, in perspective and side views, respectively. From FIGS. 9 and 10, it can be seen that the tip portion of the stylus 10 includes a center, conically-shaped portion 14 having a sharp tip on the distal end thereof. Positioned immediately around the conical tip portion 14 of the stylus is a concave surface 15 extending inwardly along the axis of the stylus. The concave shape of the area immediately outward from the central, pointed portion 14 of the stylus results in a sharp circular edge being formed around the periphery of the end of the stylus shaft 12. The sharp peripheral edge of the end portion of the stylus shaft 14 causes the prescored portion of the data card to be cleanly and completely severed from the remaining portion of the data card when the perforating stylus is inserted through the data card. This can be seen and will be explained with reference to FIGS. 5–8.

FIG. 5 shows the perforated portion 18A of the data card 18 impacted by and displaced by the tip portion 14 of the stylus of the perforating stylus 10. FIG. 6 shows further displacement of the stylus where the tip portion 14 and the end portion of the stylus shaft 12 have been inserted through the data card 18 and planar upper portion 50A of the chip retaining mat. FIG. 7 shows the further displacement from the chip retaining mat of the prescored portion 18A of the data card. From FIGS. 6 and 7 it can be seen that following the initial severance of the prescored portion 18A, it remains in a slightly curved shape due to the previously exerted stylus pressure imposed thereupon. Insertion of the sharp edged portion of the end of the stylus shaft 12 causes the distorted prescored portion 18A to be quickly severed and forcefully displaced from the data card 18. The sharp peripheral edge of the end of the shaft portion of the stylus insures complete severance of the prescored portion of the data card therefrom and the formation of an aperture therein comprised of well-defined edges permitting more accurate and reliable data recording. FIG. 8 shows the perforating stylus 10 withdrawn from the data card 18 following insertion therethrough and severance of the prescored portion 18A therefrom. The aperture 60 thus formed in the data card 18 by the severance and displacement of the prescored portion 18A thereof is achieved by the unique configuration of the perforating stylus of the present invention and is achieved without modifying the underlying data card supporting structure, incorporating special perforations in the data card, or requiring multiple insertions of the perforating stylus to insure complete chip separation from the data card.

While particular embodiments of the present invention have been shown and described, it will be apparent to those skilled in the art that changes and modifications may be made therein without departing from the invention and its broader aspects. For example, although the shaft of the stylus of the present invention is shown as having a generally circular cross-section, it is not limited to this configuration. Virtually any cross-sectional shape can be assumed by the stylus in carrying out the invention provided the end thereof is recessed so as to form a sharp edge around the periphery thereof and the center, tipped projection extends beyond the sharp-edge end of the shaft. The aim in the appended claims, therefore, is to cover all such changes and modifications as fall within the true spirit and scope of the invention.

We claim:

1. A stylus for use with a device for recording information on a record card by entering perforations on selected, prescored portions thereof, said device including a resilient template positioned beneath said record card and providing support therefor and including a plurality of openings aligned with the prescored portions of said record card for receiving said prescored portions when said perforations are engaged and removed from said record card, the stylus for making said perforations in said record card comprising:

a linear shaft having an end portion, said end portion including a recessed center section so as to form a sharp edge around the periphery of said end portion; and a projection securely mounted in the recessed center section of the end portion of said shaft wherein the cross-sectional dimensions of said projection are smaller than those of said shaft end portion and said projection includes a pointed distal end therof extending beyond the end portion of said shaft.

2. A perforating stylus in accordance with claim 1 wherein said end portion thereof has a circular cross-sectional shape.

3. A perforating stylus in accordance with claim 2 wherein said recessed center section of said end portion thereof is concave.

4. A perforating stylus in accordance with claim 1 including a cylindrically-shaped insert fixedly positioned in said recessed center section of said end portion of said linear shaft, said cylindrically shaped insert including a sharply pointed portion on the distal end thereof forming said projection.

5. A perforating stylus in accordance with claim 1 wherein the cross-sectional dimensions of said end portion of said linear shaft are smaller than the dimensions of the openings of said resilient template.

6. A stylus for use with an apparatus for recording information on a record card by entering perforations on selected portions thereof, comprising:

a linear shaft having an end portion, said end portion including a recessed center section so as to form a sharp edge around the periphery of said end portion; and a projection securely mounted in said recessed center section of said end portion of said shaft wherein the cross-sectional dimensions of said projection are smaller than those of said shaft end portion and said projection includes a pointed distal end thereof extending beyond the end portion of said shaft.

7. A perforating stylus in accordance with claim 6 wherein said end portion of said shaft has a circular cross-sectional shape.

8. A perforating stylus in accordance with claim 7 wherein said recessed center section of said end portion of said shaft is concave.

9. A perforating stylus in accordance with claim 6 including a cylindrically-shaped insert fixedly positioned in the recessed center section of the end portion of said linear shaft, said insert including a sharply pointed portion on the distal end thereof forming said projection.

* * * * *